United States Patent [19]

Ramillon

[11] Patent Number: 4,947,733

[45] Date of Patent: Aug. 14, 1990

[54] VALVE SUBPLATE FOR ALTERNATIVE DOUBLE-ACTING OR SINGLE-ACTING OPERATION OF CYLINDER

[75] Inventor: Jean-Pierre Ramillon, Perly, Switzerland

[73] Assignee: Honeywell Lucifer S.A., Carouge, Switzerland

[21] Appl. No.: 264,359

[22] Filed: Oct. 31, 1988

[30] Foreign Application Priority Data

Nov. 19, 1987 [EP] European Pat. Off. ..... 87810677

[51] Int. Cl.[5] ..... F15B 13/00

[52] U.S. Cl. ..... 91/466; 91/469; 91/34

[58] Field of Search ..... 91/34, 466, 54, 469

[56] References Cited

U.S. PATENT DOCUMENTS

| | | | |
|---|---|---|---|
| 752,472 | 2/1904 | Schilde | 91/34 |
| 1,604,587 | 10/1926 | Knight | 91/34 |
| 3,218,938 | 11/1965 | Bishop | 251/31 X |
| 3,818,800 | 6/1974 | Bertaux | 91/466 X |
| 4,090,429 | 5/1978 | Kamimura | 91/466 |

*Primary Examiner*—Edward K. Look
*Assistant Examiner*—George Kapsalas
*Attorney, Agent, or Firm*—Young & Thompson

[57] ABSTRACT

A valve with four passages controls a piston (15) disposed in a cylinder (16). Between the body (1) of the valve and the cylinder (16) is disposed a plate (23) having passages (24, 25) which are used and a passage (26) which is not used in FIG. 1. By turning plate (23) 180°, the passage (24) is located in the non-use position, while the passage (26) connects the conduits (19 and 13) in such a way as to cause the space (21) of the cylinder (16) to communicate continuously with an exhaust orifice (6).

5 Claims, 1 Drawing Sheet

VALVE SUBPLATE FOR ALTERNATIVE DOUBLE-ACTING OR SINGLE-ACTING OPERATION OF CYLINDER

BACKGROUND OF THE INVENTION

Apparatus for controlling a piston disposed in a cylinder closed at each end is already known, this cylinder being controlled by a valve with two outlet orifices, adapted to connect at least one of the spaces located on each side of the piston alternatively to a source of fluid under pressure and an exhaust conduit.

In the case of a double-acting cylinder comprising a piston displaceable in a chamber closed at each end, the piston is controlled by a four-passage valve, with two outlet orifices, adapted to connect alternatively the spaces located on each side of the piston to a source of fluid under pressure and to one or two exhaust conduits which return the fluid to a reservoir in the case of oil.

In other embodiments, the cylinder comprises only one space to which is fed fluid under pressure. In this case, it is a single-acting cylinder.

It is known that the two types of cylinders may be controlled by the same type of valve by stopping the unused openings in the case of the control of a single-acting cylinder.

In this last case, the space opposite that provided to be placed under pressure communicates with the atmosphere and, under the effect of the reciprocation of the piston, draws in and then ejects ambient air. The piston being generally lubricated—even if the fluid under pressure is compressed air—the lubricant is therefore in contact with the ambient air, which is unacceptable in certain types of application, particularly in food, pharmaceutical, chemical industries where it is absolutely necessary to avoid contamination of the products by lubricant, even in infinitesimal quantities. To overcome this drawback, said space should be closed and be connected to a conduit permitting recovery of the air and the oil vapors, which requires a special installation.

SUMMARY OF THE INVENTION

The invention has for an object to use a control apparatus which can be easily adapted to single-acting cylinders or double-acting cylinders. This object is attained thanks to the fact that the apparatus comprises means permitting as desired causing one of the spaces to communicate either alternatively with the source of pressure and an exhaust conduit, or continuously with an exhaust conduit.

BRIEF DESCRIPTION OF THE DRAWINGS

The accompanying drawings shows, schematically and by way of example, an embodiment of the device which is the object of the invention.

DETAILED DESCRIPTION OF THE PREFERRED EMBODIMENTS

Figure 1:
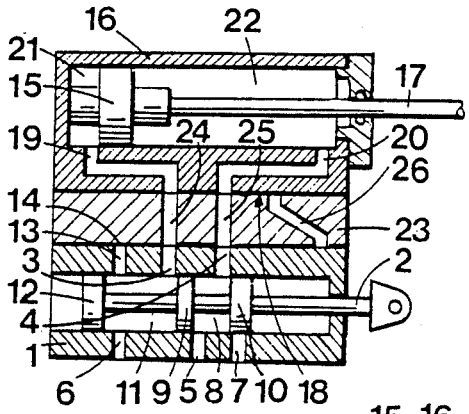
FIG. 1 shows schematically a four-passage valve connected to a double-acting cylinder.

Referring to FIG. 1, a slide valve comprises a body 1 in which a slide 2 may be displaced by any appropriate means acting on the slide. This four-passage valve has as is conventional two outlet orifices 3 and 4 and an inlet orifice 5 for fluid under pressure. Body 1 also has two exhaust passages 6 and 7, adapted to be connected to a common exhaust conduit not shown. Of course, the passages 6 and 7 could be interconnected by a passage provided in body 1, such that the valve would have only a single exhaust orifice to connect to said conduit.

In the illustrated position, the inlet orifice 5 is connected to the outlet orifice 4 by the space 8, bounded by two lands 9 and 10 on the slide, while the outlet orifice 3 is connected to the channel 6 by the space 11 defined between the lands 9 and 12. It should be noted that a channel 13 having an outlet orifice 14 also opens into space 11.

The valve is adapted to control the displacements of piston 15 displaceable within a cylinder 16. This piston 15 is integral with a rod 17 permitting transmitting movements of the piston to any movable external member. The cylinder 16 also has a flat portion 18 and contains two conduits 19 and 20, adapted to connect the outlet orifices 3 and 4 to the spaces 21 and 22 located on opposite sides of the piston 15.

The communication between the orifices 3 and 4 and the conduits 19 and 20 is effected by a plate 23 clamped between the valve and the cylinder 16, this plate having passages 24, 25 and 26 extending from one of its faces to the other.

The plate 23 can occupy two different positions between the cylinder and the valve, so as to ensure different communications between the outlet orifices of the valve and the spaces 21 and 22. In the case illustrated in FIGS. 1 and 2, the passage 26 of the plate 23 is unused, the spaces 21 and 22 being placed in communication with the orifices 3 and 4 of the valve by the passages 24 and 25 of the plate 23.

Figure 2:
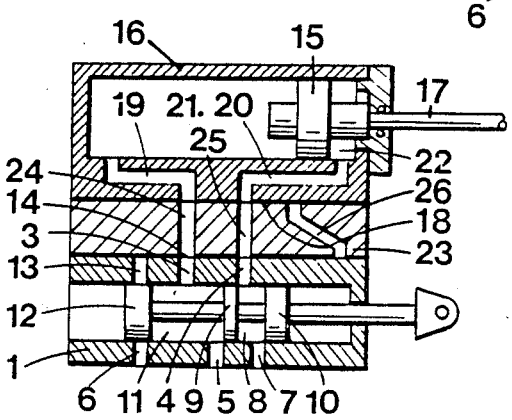
FIG. 2 is a similar view showing the position of the valve to control a displacement of a piston disposed in the cylinder in the opposite direction from that shown in FIG. 1.

In the position shown in FIG. 2, the valve occupies its other position in which the inlet orifice 5 communicates via the space 11 with the outlet 3, while the outlet 4 and the exhaust channel 7 are interconnected by the space 8 comprised between the lands 9 and 10. Thus, the fluid under pressure is conducted into space 21, which pushes the piston 15 again toward the right, while in the case of FIG. 1 the fluid under pressure was introduced into space 22 to displace the piston 15 toward the left.

In the case of FIGS. 1 and 2, the passages of the plate 23 permit connecting the cylinder 13 to the body 1 of the valve to obtain an altogether conventional operation.

Figure 3:
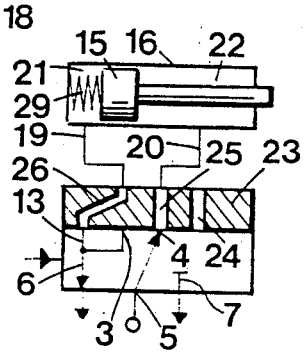
FIGS. 3 and 4 are simplified views analogous to FIGS. 1 and 2 in the case of a single-acting cylinder.
Figure 4:
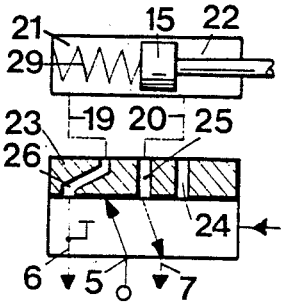

When the cylinder to be controlled is of the single-acting type, the same elements may be used, as shown in FIGS. 3 and 4. Only the position of mounting the plate 23 is changed in the sense that it has been subjected to a 180° turn so that the side of this plate which was to the right in FIG. 1 is now disposed to the left side. In this new position of the plate, the conduit 20 still communicates by the passage 25 of the plate with the outlet 4 of the valve. On the other hand, the conduit 19 now communicates via the passage 26 with the outlet channel 13 of the valve, the outlet orifice 3 being now closed by the plate 23. The passage 24 of the plate 23 is now unused.

Thanks to this arrangement, the space 21 of cylinder 16, which encloses a return spring 29, is continuously in communication with the exhaust conduit not shown, this communication being established by the conduit 19, the passage 26, the channel 13, the space 11 and the channel 6. In this way, impurities which may be introduced into space 21, for example the oil vapors which are always present in the case of a piston 15 controlled by compressed air, are in communication only with the exhaust conduit not shown, this latter being adapted to be provided with a filter or to be elongated to empty into an external space in the region in which the cylinder 16 is used.

FIG. 3 shows the position of the valve in which the space 22 is connected to the orifice 5 for introducing the fluid under pressure and FIG. 4 shows this space 22 connected to the exhaust orifice 7.

Figure 5:
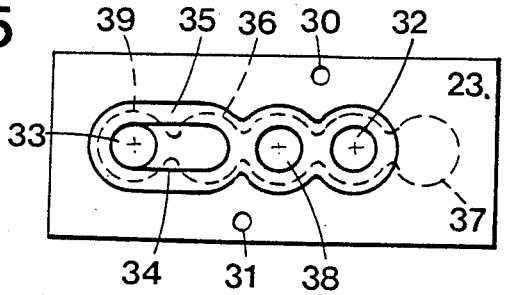
FIG. 5 shows in plan a plate having passages to cause the outlet orifices of the valve to communicate with the spaces of the cylinder.

FIG. 5 shows a possible form of execution of the plate 23. This latter is of rectangular shape and has two bores 30 and 31 adapted to be engaged on pegs secured either to the flat portion 18 of the cylinder or to the surface of body 1 which has the outlet orifices 3 and 4, or else to both at the same time. It is thus possible to place the plate in two positions offset by 180°, the bore 30 taking the place of bore 31 and vice versa. The plate also has two holes 32 and 33, adapted to cause the outlet orifices 3 or 14 to communicate with the conduit 19, according to the position given to the plate 23, the hole 38 communicating in both positions with the conduit 20.

The hole 33 communicates with an end of a groove 34 provided in the surface of the plate which is adapted to be in contact with the flat portion 18 of the cylinder 16, the other end of this groove being situated opposite opening 19. A sealing joint 35 with multiple loops is provided on said surface and surrounds the hole 32, the hole 38 and the hole 33 with the groove 34. The joint 39 on the opposite surface of the plate which is adapted to be in contact with the body 1 also has two portions 36 and 37, adapted to close one of the orifices 3 or 14, according to the way in which the plate 23 is mounted. Thus, the plate is provided on each of these surfaces with joints 35 and 39 to ensure the sealing on the one hand with the orifices of the valve and on the other hand with the conduits 19 and 20.

Of course, it is advantageous that the plate 23 carry means for indexing its two positions, these means being adapted to be visible or mechanical.

I claim:

1. In apparatus for controlling a piston disposed in a cylinder closed at each end, this cylinder being controlled by a valve with two outlet orifices, adapted to connect at least one of the spaces located on each side of the piston alternatively to a source of fluid under pressure and to an exhaust conduit; the improvement comprising means permitting selectively to cause the other space to communicate either alternatively with the source of pressure and an exhaust conduit, or continuously with an exhaust conduit, the valve having a flat surface through which open the two outlet orifices, the valve comprising an internal conduit opening also through this flat surface, this conduit being connected to the exhaust conduit of the valve, means permitting connecting the valve to the cylinder in two different positions in which one of said spaces is connected either to the internal conduit of the valve or to one of its outlet orifices, the last-named means comprising an intermediate plate by which the valve is mechanically connected to the cylinder, this plate having passages extending from one of its surfaces to its other surface to cause the outlet orifices of the valve to communicate with said spaces of the cylinder, the surface of this latter having a flat portion through which open two conduits leading respectively to each of said spaces, said plate being so shaped as to be adapted to occupy two different positions between the cylinder and the valve, the passages of the plate being so disposed as to ensure the communication between one of the spaces of the cylinder either with the internal conduit of the valve or with one of its outlet orifices, according to the position occupied by the plate.

2. Apparatus according to claim 1, characterized in that the change of the plate from one of its positions to the other is achieved by turning this plate about an axis perpendicular to its surfaces.

3. Apparatus according to claim 2, characterized in that in one of its positions, the plate closes one of the outlet orifices of the valve.

4. Apparatus according to claim 3, characterized in that the plate is provided on each of its surfaces with joints to seal on the one hand with the openings of the valve and on the other hand with the conduits leading to said spaces.

5. Apparatus according to claim 1, characterized in that the plate bears visible indexing means for its two positions.

* * * * *